US005987687A

United States Patent [19]

Kilburn

[11] Patent Number: 5,987,687

[45] Date of Patent: Nov. 23, 1999

[54] HANDLE FOR A BRISTLE HOLDING PORTION OF A BRUSH

[76] Inventor: Jacquelin Kilburn, 10315 Moon Lake Ct., Pinckney, Mich. 48169-9305

[21] Appl. No.: 09/021,915

[22] Filed: Feb. 11, 1998

Related U.S. Application Data

[60] Provisional application No. 60/038,055, Feb. 18, 1997.

[51] Int. Cl.[6] ..... A46B 5/02

[52] U.S. Cl. ..... 15/145; 15/143.1; 15/176.1; 601/137; D4/130; D4/138

[58] Field of Search ..... 15/143.1, 145, 15/146, 176.1–176.6; 601/137, 138; D4/130, 132, 134, 135, 137, 138

[56] References Cited

U.S. PATENT DOCUMENTS

| | | | |
|---|---|---|---|
| 1,398,864 | 11/1921 | Kelly | 15/143.1 X |
| 2,557,267 | 6/1951 | Ellinger | 15/176.1 X |
| 2,802,229 | 8/1957 | Bangs | 15/143.1 |
| 4,283,808 | 8/1981 | Beebe | 15/145 |
| 5,003,659 | 4/1991 | Paepke | 15/145 X |

FOREIGN PATENT DOCUMENTS

| | | | |
|---|---|---|---|
| 30546 | of 1910 | United Kingdom | 15/143.1 |

OTHER PUBLICATIONS

Southpaw Enterprises' 1997 Collection catalog, p. 51.

*Primary Examiner*—Mark Spisich
*Attorney, Agent, or Firm*—Barbara M. Burns

[57] ABSTRACT

A handle for a bristle holding portion of a brush. The handle is ergonomically shaped to fit a user's hand. The handle is configured into a longitudinal cylinder and can be resilient to further increase the user's comfort. The handle can be sanitized for use with different brushes for different clients. Hook and loop fasteners connect the handle to the bristle holding portion. The handle and the bristle holding portion are either readily separable and rejoinable, allowing the handle to be readily transferable to another bristle holding portion, or alternately, the handle is fixedly formed to the bristle holding portion.

3 Claims, 2 Drawing Sheets

HANDLE FOR A BRISTLE HOLDING PORTION OF A BRUSH

REFERENCE TO RELATED APPLICATION

This application is based on provisional patent application 60/038,055, filed Feb. 18, 1997.

BACKGROUND OF THE INVENTION

The field of the invention pertains to brushing devices and in particular, to therapeutic brushing devices for use by therapists or other treatment providers. Brushing of parts of the body is known to stimulate sensory response, sensory integration, and development in patients having challenged sensory processing. Therapists use surgical scrub brushes, corn silk or vegetable brushes or other type bristle brushes to deliver the sensory input to the patient. However, a problem is caused by these brushes in that the side of the brush away from the bristles is often not ergonomically designed to the user's hand. Consequently the brush is uncomfortable to use and can cause cramping and resultant slippage from the therapist's grasp. A known attempt to solve this problem has been to frictionally engage a non-resilient handle to a brush. The non-resilient handle has a shape that forces the therapist or other user to hold the gripping hand in an awkward position that can encourage cramping and pain to the fingers and the hand. A solution to this problem is needed.

Non-therapeutic users of brushes and other hand held implements also experience cramping and discomfort when holding implements in a continuous grip. Likewise, a solution is needed that could benefit both therapeutic and non-therapeutic users alike.

Therefore, a more effective and comfortable device for a brush is an advantageous goal. A more effective and comfortable device and method for use of the device are disclosed below.

SUMMARY OF THE INVENTION

The invention comprises a handle for a brush. The handle can be either permanently attached to or be attachable and detachable for engagement and disengagement with the bristle holding portion of a brush. Thus, the handle can be transferable to similar brushes. Transferability of the handle is useful because the bristles of the brushes wear and the bristle holding portion must be replaced. Moreover, a single handle can be sanitized and used with the brushes of several different clients.

The handle is ergonomically shaped to fit the curved shape space of a user's hand. Consequently, the handle is comfortably fittable to the user's hand. Materials that are suitable for the ergonomically shaped handle can be a variety of materials, resilient and solid, such as plastic, wood, foam, etc. The preferred embodiment employs resilient material for the handle.

The handle can be formed integrally as a unit to the bristle holding portion or the handle can be formed as the bristle holding portion is formed. The handle can also be separate and is attachable and detachable from the bristle holding portion of the brush. Due to the ergonomic shape as well as the use of resilient material, cramping and/or discomfort is substantially reduced. Thus, the handle is not only extremely comfortable to use, but moreover, the handle can be detachable and thus transferable and reattachable to other bristle holding portions. This detachability and reattachability of the handle is a convenient feature.

The handle is generally configured as a longitudinal cylinder. The longitudinal cylinder can extend into a boss having an engagement area thereon. The handle engagement area is fittable to an engagement region on the bristle holding portion of a brush.

The bristle holding portion of any brush as described above generally has an opposite face away from the bristles. From the opposite face, usually extend at least two parallel upwardly extending edges. Some of the brushes have four upwardly extending edges forming a contiguous edge. In any event, the bristle holding portion has an engagement region generally between the upwardly extending edges.

The engagement area on the boss is fittable to the engagement region on the bristle holding portion. These surfaces engage whether the engagement surface on the bristle holding portion is within a space created between the upwardly extending edges or not. Accordingly, the engagement area of the device can fit with another engagement region on the bristle holding portion, if need be.

Means for engaging the device to the bristle holding portion can employ hook and loop fasteners. Velcro is one well known brand name for hook and loop fasteners. Means for engaging and disengaging are deployed on the corresponding engagement area and engagement region. Other attachment methods such as double sided tape, etc. could be advantageously employed herein.

DESCRIPTION OF THE PREFERRED EMBODIMENTS

Figure 1:
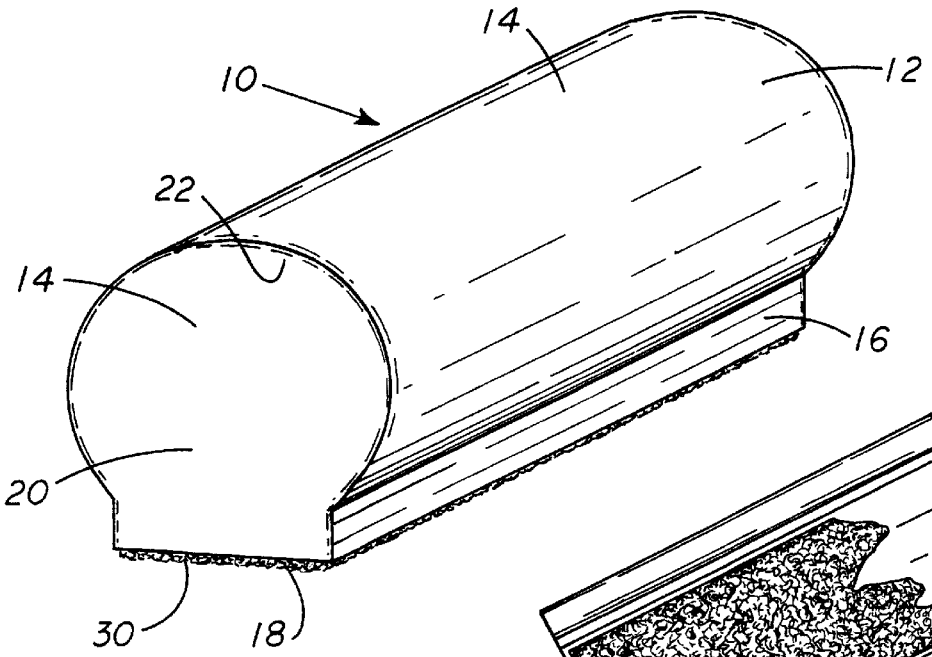
FIG. 1 illustrates a perspective view of the handle according to the invention.
Figure 1A:
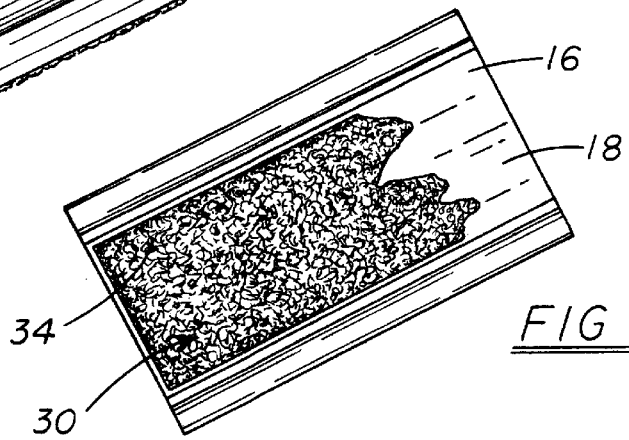
FIG. 1A illustrates a bottom view of the handle showing the engagement area.

In FIG. 1, a handle 10 is illustrated as comprising a body 12 partially shaped as longitudinal cylinder 14. The longitudinal cylinder 14 is expanded on the bottom side into a depending rectilinear boss 16 having an engagement area 18 thereon. The engagement area 18 on the depending rectilinear boss 16 of the handle 10 is better depicted in FIG. 1A.

The longitudinal cylinder 14 fits easily into a user's hand. The body 12 is comprised from resilient material such as a foam 20 having a skin coat 22 formed thereon. The foam 20 is light weight and can be formed from material such as or similar to Insulate foam. The skin coat 22 can be formed from a vinyl coating. The skin coat 22 protects the interior material from becoming dampened by bodily fluids or therapeutic fluids or lotions used during a treatment session. Alternately, the body can be comprised from many other suitable materials, such as plastics, natural materials, etc.

Figure 2:
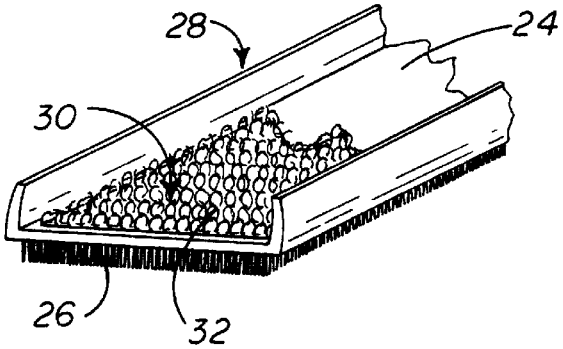
FIG. 2 illustrates a perspective view of the brush handle with the engagement region of the brush oriented towards the engagement area of the handle.

In FIG. 2, is shown the bristle holding portion 26 of a brush 28 having an engagement region 24. Means for engaging and disengaging 30, such as interengageable hook 32 and loop 34 fasteners are employed. Either the hook or the loop segment of the hook and loop fasteners is disposed on either the engagement area 18 of the rectilinear boss 16 of the body 12 or on the engagement region 24 of the bristle holding portion 26. Conversely, the other of the hook or the loop segment is disposed on the other of the engagement area 18 of the rectilinear boss 16 of the body 12 or on the engagement region 24 of the bristle holding portion 26. Accordingly, the body 12 is attached to the bristle holding portion 26 by engaging the means for engaging and disengaging 30. Detachment of the body 12 from the bristle holding portion 26 is effected by disengaging the means for engaging and disengaging 30. However, it is to be understood that the handle can be formed directly to the bristle holding portion of a brush.

Figure 3:
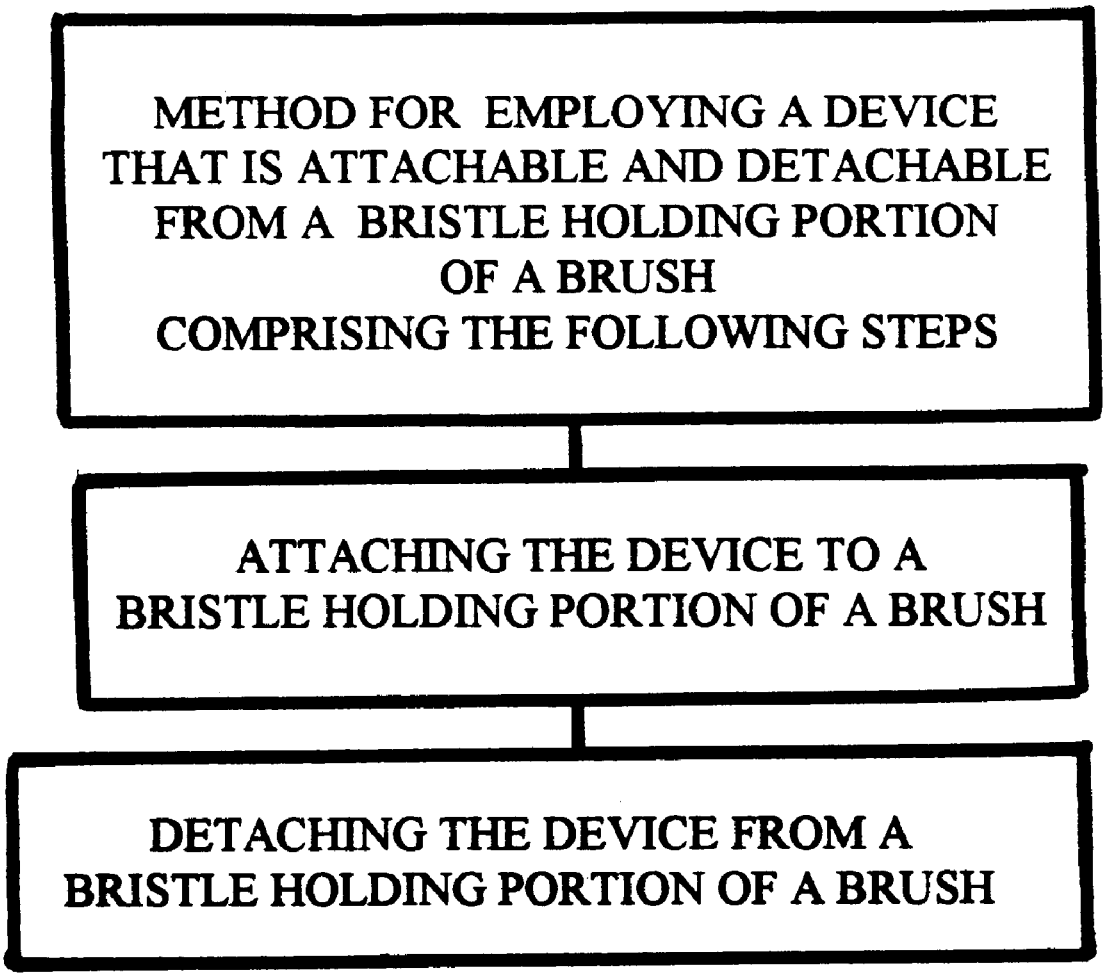
FIG. 3 illustrates the method for employing a device for attaching to a bristle holding portion of a brush.

In FIG. 3 a method is depicted for employing a device (such as the handle as herein described) that is attachable and detachable from a bristle holding portion of a brush comprising the following steps attaching the device to a bristle holding portion of a brush; and detaching the device from a bristle holding portion of a brush.

It is to be understood that the device and the method of employing the device as herein described could be employed for use with other products or implements and for other purposes beyond those for sensory integration, sensory development, and motor development.

I claim:

1. A brush comprising:

(a) an elongated ergonomically shaped foam body, said body being partially shaped as a longitudinal cylinder and having an elongated rectilinear boss extending along the length of and depending from a bottom portion of said longitudinal cylinder, said rectilinear boss having on a bottom thereof an engaging means comprising one of a hook and loop fastener; and (b) an elongated bristle holding portion comprising a substantially planar member having an upper and a lower surface, said upper surface having engaging means for cooperating with the engaging means of the ergonomically shaped body, the engaging means of the bristle holding portion comprising the other of a hook and loop fastener, the upper surface of said substantially planar member further having extensions extending along opposite sides thereof and said lower surface carrying a plurality of bristles.

2. A method for assembling and subsequently disassembling the brush according to claim 1 comprising the following steps attaching the elongated ergonomically shaped foam body to the elongated bristle holding portion; and detaching the elongated ergonomically shaped foam body from the elongated bristle holding portion.

3. A handle device for attaching to a bristle holding portion of a brush, the bristle holding portion of the brush being a substantially planar member having an upper and a lower surface, said upper surface having engaging means for cooperating with engaging means on a handle device, the engaging means of the bristle holding portion comprising one of a hook and loop fastener, the upper surface of said substantially planar member further having extensions extending along opposite sides thereof and said lower surface carrying a plurality of bristles, the handle device comprising:

an ergonomically shaped foam body fittable to the bristle holding portion, the foam body partially shaped as a longitudinal cylinder and having an elongated rectilinear boss extending along the length of and depending from a bottom portion of said longitudinal cylinder, said rectilinear boss having on a bottom thereof an engaging means comprising the other of a hook and loop fastener for engagement with the one of a hook and loop fastener on the bristle holding portion.

* * * * *